US006116454A

United States Patent [19]

Henderson et al.

[11] Patent Number: 6,116,454

[45] Date of Patent: Sep. 12, 2000

[54] HYDRAULIC OIL TANK WITH INTEGRAL BAFFLE

[75] Inventors: David D. Henderson, Sanford; William C. Swick, Raleigh; Reid W. Waitt, Willow Springs, all of N.C.

[73] Assignee: Caterpillar Inc., Peoria, Ill.

[21] Appl. No.: 09/165,255

[22] Filed: Oct. 1, 1998

[51] Int. Cl.[7] ..... B65D 11/22; E03B 11/00

[52] U.S. Cl. ..... 220/563; 137/571

[58] Field of Search ..... 220/563, 564; 137/574, 576, 571

[56] References Cited

U.S. PATENT DOCUMENTS

| | | | |
|---|---|---|---|
| 2,942,611 | 6/1960 | Klank, Jr. et al. . | |
| 3,595,422 | 7/1971 | Durrett, Jr. | 220/563 |
| 4,143,193 | 3/1979 | Rees . | |
| 4,431,027 | 2/1984 | Sabina, Jr. | 220/563 |
| 4,526,286 | 7/1985 | Jung et al. | 220/563 |
| 5,127,432 | 7/1992 | Duhaime et al. | 220/563 |
| 5,251,773 | 10/1993 | Bowles et al. | 220/563 |
| 5,564,749 | 10/1996 | Branham . | |
| 5,850,933 | 12/1998 | Pazik | 220/563 |

*Primary Examiner*—Joseph M. Moy
*Attorney, Agent, or Firm*—August E. Roehrig, Jr.

[57] ABSTRACT

A rotomolded hydraulic oil tank includes an integral dividing baffle which strengthens the tank structure, and diverts and slows returning oil for better air removal and oil mixing. This occurs by positioning the dividing baffle so that the top of the baffle is just below the oil level in the tank so that returning oil must flow a greater distance around the baffle at a reduced velocity thereby increasing the time the oil is in the tank before exiting the tank through the tank suction. The lower velocity of the oil and the increased passage time allows air in the returning oil more time to float to the surface of the oil in the tank.

11 Claims, 2 Drawing Sheets

2/2
100
2
5
24
4
6
7
21
1

9
7b
7c
8
7a
11b
11
12
12a
12b
11a
10
13
13a
13b
15
3
22

HYDRAULIC OIL TANK WITH INTEGRAL BAFFLE

TECHNICAL FIELD

This invention relates generally to rotationally molded oil containers and, more particularly, to an oil container formed with an integral baffle for enhancing air removal from the oil passed into the container and to improve oil mixing.

BACKGROUND ART

In the operation of work machines and construction vehicles, quantities of hydraulic oil are used to control various machine operations, functions, and the work implements associated with the machine. Some or all of such hydraulic oil is re-circulated through the machine and components, passing through an oil reservoir tank before being again circulated through the hydraulic circuit.

When such oil is drawn from the oil reservoir tank and passed through the hydraulic circuit to a point of use, and then returned to the reservoir tank for subsequent re-use, varying quantities of air become entrained in the oil. One attempt to remove such entrained air is disclosed in U.S. Pat. No. 2,942,611 wherein oil returning to an oil reservoir tank passes through a common inlet port into an open-ended cylinder which functions as a deaerator. The returning oil is directed into the open-ended cylinder deaerator at a tangent to descend through the cylinder in a swirling motion for facilitating the release of air entrained with the returning oil. The air rises through the open upper end of the cylinder passing into the upper portion of the tank for venting. While such a system may function appropriately for the particular application described, such a deaerator system requires the addition of an extra component, the open-ended cylinder, and does not increase the strength of the tank to dampen any forces of surging liquid during sudden stops.

In U.S. Pat. Nos. 5,564,749 and 4,143,193 there are disclosed hydraulic oil tanks which incorporate structure such as a kiss-off or internal baffles, respectively, which function to increase the strength of the oil tank or container to dampen surges and prevent rupturing. However, neither of the structures disclosed in these patents perform any function relating to the deaeration of air entrained in the oil contained in the containers.

The present invention is directed to overcome one or more of the problems as set forth above.

DISCLOSURE OF THE INVENTION

In the preferred embodiment of this invention an integral baffle is formed which strengthens the tank structure and functions to deflect the flow of oil returning into the bottom of the tank. Forming the baffle as an integral portion of the tank strengthens the tank walls to dampen surges and prevent tank rupturing. Introducing the oil returning to the tank into the bottom thereof prevents the oil from penetrating the surface of the oil contained in the tank and, thereby, eliminates aeration or foaming which might be caused by such returning oil penetrating the oil surface. The baffle also disperses the returning oil into the larger volume of oil contained in the oil reservoir tank, thereby slowing the velocity of the returning oil. In this manner the air entrained in the returning oil has more time to float to the surface for venting. In addition, the baffle improves oil mixing within the tank which results in the temperature of the oil in the tank being more uniform.

The positioning of the baffle just below the oil level in the tank causes the returning oil to flow a greater distance around the baffle at a slower velocity, thereby increasing the time the oil is in the tank and facilitating air removal. In addition, at the bottom of the baffle a small passage connects the tank on both sides of the baffle to facilitate full draining of the tank through a single drain port on one side of the tank.

BRIEF DESCRIPTION OF THE DRAWINGS

In the accompanying drawings like reference numerals indicate corresponding parts throughout.

BEST MODE FOR CARRYING OUT THE INVENTION

Figures 2, 3:
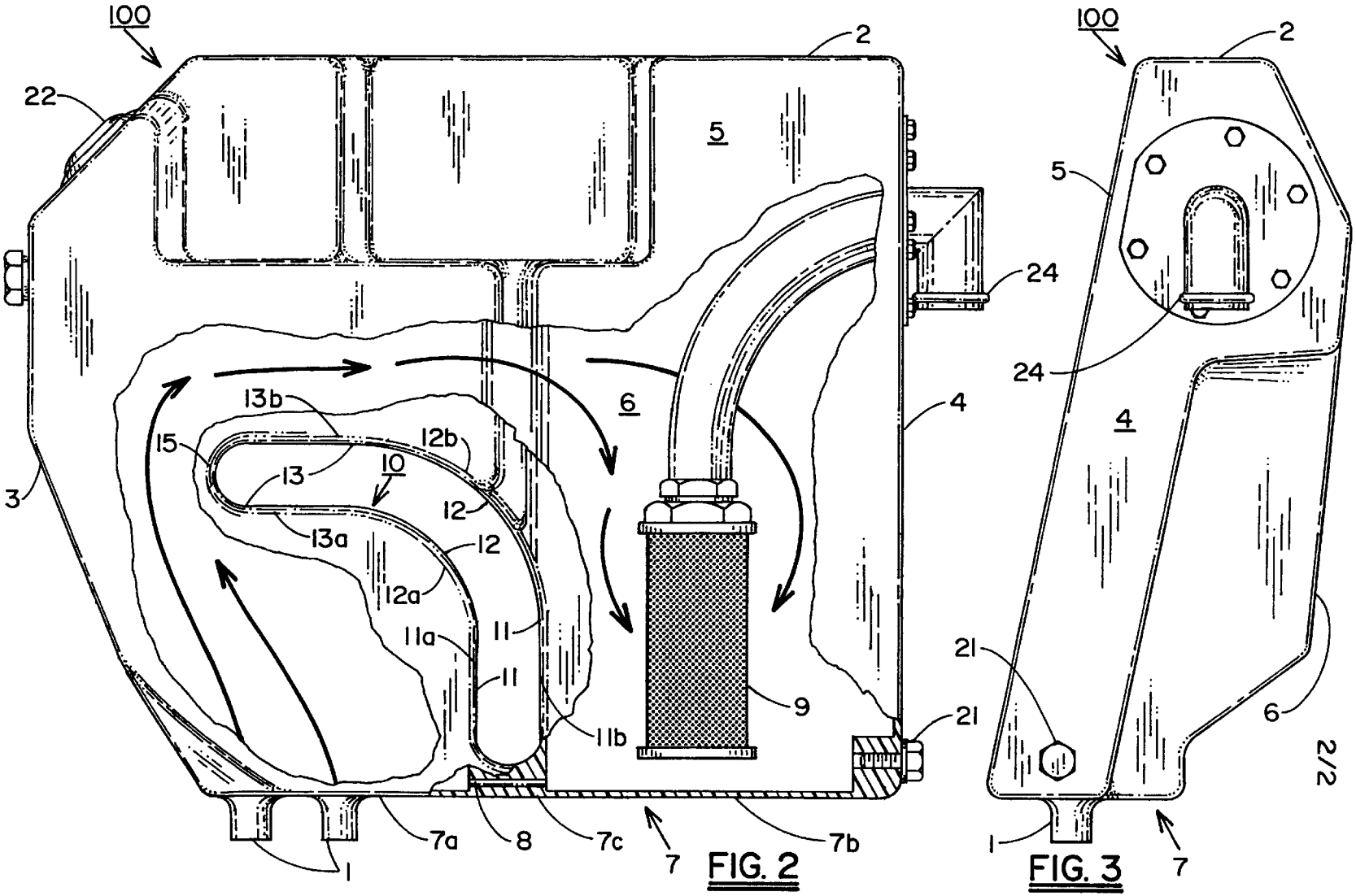
FIG. 2 is a side elevation of the oil tank illustrated in FIG. 1 with portions broken away to better illustrate the internal construction thereof, and the flow path of oil passing therethrough.
FIG. 3 is an elevational view of the outlet end of the oil tank illustrated in FIG. 2.

Referring now to the drawings, there is illustrated an oil tank reservoir 100 having an internal baffle 10 formed as an integral part of the oil tank walls. As best shown in FIG. 2, the baffle 10 is positioned in the tank with the top surface 13*b* of the baffle just below the surface of the oil in the tank. The oil tank includes a front wall 5 and a substantially parallel rear wall 6 spaced therefrom. The baffle 10 extends between the front wall 5 and the rear wall 6 of the tank 100, and extends upwardly from a bottom wall 7 of the tank which is formed in two portions 7*a* and 7*b*.

An inlet portion 7*a* of the bottom wall 7 includes two inlet ports 1 through which oil is returned to the tank 100 after passing through a hydraulic circuit. An outlet portion 7*b* of the bottom wall 7 is that portion of the bottom wall 7 which is adjacent to an outlet filter 9 through which oil is withdrawn from the tank and recirculated in the hydraulic circuit. The outlet filter 9 is coupled into fluid communication with the hydraulic circuit by a fluid coupling 24.

Figure 1:
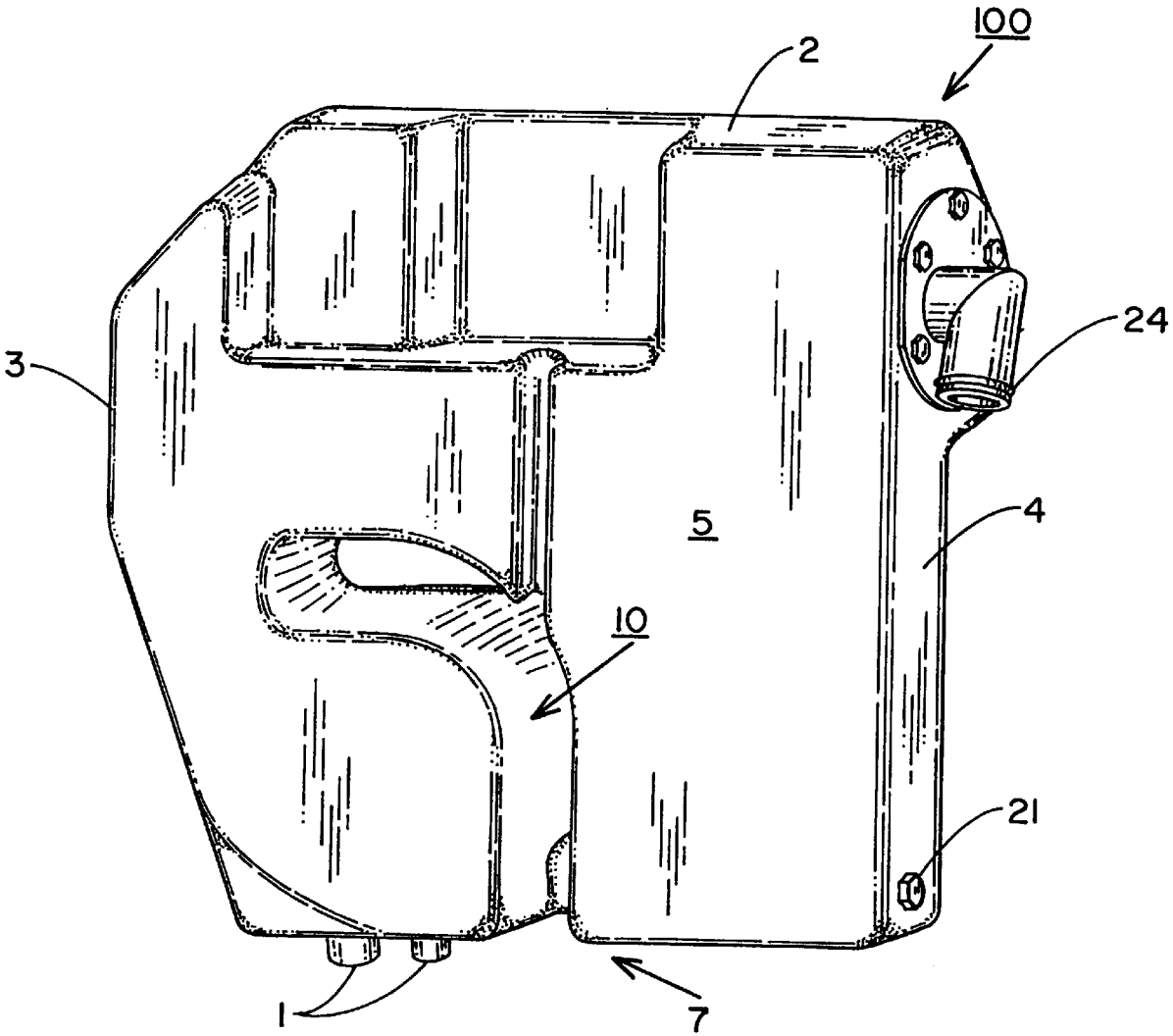
FIG. 1 is a frontal perspective view of an oil tank with an integral baffle.

The two portions of the tank bottom wall, 7*a* and 7*b*, are joined by a tunnel portion 7*c*. The tunnel portion 7*c* is formed with an aperture 8 extending therethrough connecting the two lower portions 7*a* and 7*b* of the tank 100 which are separated by the formation of the baffle 10 in fluid communication as best illustrated in FIGS. 1 and 2. A pair of end walls, 3 and 4, and a top wall 2 complete the tank enclosure. A removable cap 22 closes an opening in the top wall 2 through which quantities of make-up oil can be added to the tank 100.

The baffle 10 includes a pair of spaced parallel walls having a vertically extending portion 11 and a horizontally extending portion 13 connected by a curved portion 12. The vertically extending portion 11 of the baffle 10 extends upwardly from a point adjacent to the tank bottom wall 7, as best illustrated in FIGS. 1 and 2, and the horizontal portion 13 extends above and beyond the inlet ports 1. In this manner the discharge of oil through the inlet ports 1 is directed by the inner face 11*a*, 12*a* and 13*a* of the baffle 10 in a path of oil flow about a distal end 15 of the baffle and across the outer face 13*b*, 12*b* and 11*b* of the baffle before being withdrawn through the outlet filter 9 for recirculation through the hydraulic circuit. A drain port 21 is formed in the lower or bottom portion of end wall 4 for use in draining the contents of the tank 100. Because both of the portions of the tank divided by the baffle 10 are coupled into fluid communication by a small aperture 8 formed through the bridge portion 7*c*, the contents of the tank 100 contained in both portions can be drained through the single drain port 21, but the aperture 8 does not interfere with the intended flow path of the oil about baffle 10.

While this invention is described and shown for use with a re-circulating hydraulic system, it is to be understood that the invention could be adapted to function in any hydraulic system wherein it is desired to minimize oil foaming which results from oil penetrating the surface of oil contained in a tank or container, or in a hydraulic system wherein it is desired to remove air entrained in the oil entering the container.

INDUSTRIAL APPLICABILITY

During operation of work machines and construction vehicles employing hydraulically operated controls or work implements, the hydraulic oil used for such operations may be re-circulated through the controls and/or work implements in a hydraulic circuit which utilizes a oil tank or reservoir 100 for retaining a quantity of oil for such use. Oil which is returned to the tank 100 through the inlet ports 1 for re-use in the hydraulic circuit, frequently contains entrained air which should be removed from the oil for better equipment operation. To this end, the baffle 10 is positioned adjacent to the inlet ports 1 to direct the flow of oil returning to the tank 100 in a path of movement as illustrated by the arrows in FIG. 2, with the top portion 13*b* of the baffle positioned just below the level of the oil contained in the tank.

As best shown therein, upon entering the tank 100 the returning oil is directed about the inner surfaces 11*a*, 12*a* and 13*a* of the baffle 10, passing about the distal end 15 and across the outer baffle surfaces 13*b*, 12*b* and 11*b* before entering the outlet filter 9 for re-use in the hydraulic circuit. This path of oil movement imposed by the baffle 10 decreases the flow rate of the oil entering and passing through the tank 100, and increases the length of time the oil is retained in the tank so that air entrained in the oil can rise to the surface and be vented from the tank 100, rather than being re-circulated through the hydraulic circuit. In addition, the positioning of the baffle 10 disperses the oil entering the tank into the oil already ccontained in the tank, which results in the enhanced mixing of the oil and the consequent increased uniformity of the oil temperature.

While this invention has been described in the specification and illustrated in the drawings with reference to a preferred embodiment, the structure of which has been disclosed herein, it will be understood by those skilled in the art to which this invention pertains that various changes or modifications may be made and equivalents may be substituted for elements of the invention without departing from the scope of the claims. Therefore, it is intended that the invention not be limited to the particular embodiment disclosed in the specification and shown in the drawings as the best mode presently known by the inventors for carrying out this invention, nor confined to the details set forth in the preferred embodiment, but that the invention will include all embodiments, modifications and changes as may come within the scope of the following claims:

What is claimed is:

1. An oil reservoir for retaining a quantity of oil including:

a container for retaining a quantity of oil;

said container having at least two side walls, a bottom wall and an oil inlet port for introducing oil into said container at a position beneath the surface of the quantity of oil contained in said container causing the oil being introduced into said container to move in a flow path;

a baffle for controlling the flow path of oil introduced into said container, said baffle being integrally formed as a portion of said container and extending between said two side walls thereof;

said baffle having a portion extending substantially vertically upward from a position adjacent to said container bottom wall and parallel to the flow path of oil introduced into said container through said inlet port, a substantially horizontal portion extending above said oil inlet port and beneath the surface of the quantity of oil contained in said container, and a curved portion extending from said substantially vertically extending portion to said substantially horizontal portion;

said substantially vertically extending portion of said baffle, said curved portion of said baffle and said substantially horizontally extending portion of said baffle positioned in the flow path of oil to move the flow path of oil introduced into said container through said inlet port in a path of movement along said vertical portion, said curved portion and said horizontal portion of said baffle for diverting and slowing the flow of oil introduced through said input port.

2. The oil reservoir of claim 1 wherein said container further includes a top wall forming an enclosure, and a removable cap covering an opening in said top wall through which make-up oil can be added to said container.

3. The oil reservoir of claim 2 wherein said bottom wall is formed in at least two portions separated by said baffle and a tunnel portion, a tunnel portion including a drain aperture extending therethrough and coupling said at least two bottom wall portions in fluid communication, a removable drain plug carried by one of said at least two bottom wall portions for draining the contents of said container through said drain plug.

4. The oil reservoir of claim 2 further including a coupling for connecting the outlet to a hydraulic circuit.

5. An oil reservoir for retaining a quantity of oil to be recirculated through a hydraulic circuit including:

a container for retaining a quantity of oil to be recirculated from said container, through a hydraulic circuit, and back into said container;

said container having at least two side walls, a bottom wall and an oil inlet port for introducing oil into said container at a position beneath the surface of the quantity of oil contained in said container causing the oil being introduced to move in a flow path toward an oil outlet carried by said container;

a baffle for controlling the flow path of oil moving through said container, said baffle being integrally formed as a portion of said container and extending between said two side walls thereof;

said baffle having a portion extending substantially vertically upward from a position adjacent to said container bottom wall and parallel to the flow path of oil introduced into said container through said inlet port, a substantially horizontal portion extending above said oil inlet port and beneath the surface of the quantity of oil contained in said container, and a curved portion extending from said substantially vertically extending portion to said substantially horizontal portion;

said substantially vertically extending portion of said baffle, said curved portion of said baffle and said substantially horizontally extending portion of said baffle positioned to intercept the flow path of oil introduced into said container through said inlet port to cause the flow path of oil to move in a path of movement along said vertical portion, said curved portion and said horizontal portion of said baffle for diverting and slowing the flow of oil introduced through said input port; and an oil outlet positioned in the path of oil flow downstream from said baffle for removing oil from said container.

6. The oil reservoir of claim 5 wherein said container further includes a top wall forming an enclosure, and a removable cap covering an opening in said top wall through which make-up oil can be added to said container.

7. The oil reservoir of claim 5 wherein said bottom wall is formed in at least two portions separated by said baffle and a tunnel portion, a tunnel portion including a drain aperture extending between said at least two bottom wall portions and coupling said portions in fluid communication, a removable drain plug carried by one of said at least two bottom wall portions for draining the contents of said container through said drain plug.

8. The oil reservoir of claim 5 further including a coupling for connecting the outlet to a hydraulic circuit.

9. A method of treating recirculating oil to reduce the amount of air entrained in the oil and to improve the uniformity of the temperature of the oil being recirculated comprising the steps of:

introducing a quantity of recirculating oil into a container for retaining a quantity of oil to be recirculated through a hydraulic circuit and returned to said container, at a position beneath the surface of the quantity of oil contained in said container;

said step of introducing a quantity of oil creating a flow path of oil through said container to an outlet therefrom; and intercepting the flow path of oil so created by positioning a baffle having a substantially vertically extending portion extending substantially vertically upward from a position adjacent and substantially parallel to the flow path of oil introduced into said container, a substantially horizontally extending portion extending across the flow path of oil being introduced into said container and a curved portion extending from said substantially horizontally extending portion to said substantially vertically extending portion;

said step of intercepting the flow path of oil slowing the flow of oil introduced into said container and causing the flow path of oil to pass about said baffle to facilitate the removal of air entrained in the recirculating oil introduced into said container and mixing the oil introduced into said container with the oil retained in said container to improve the uniformity of the temperature of the oil in said container.

10. The method of claim 9 further including the step of withdrawing oil from said container downstream from said baffle.

11. The method of claim 9 wherein said step of introducing a quantity of recirculating oil into a container and said step of withdrawing oil from said container occur at the same flow rate.

* * * * *